United States Patent [19]

Fischer

[11] Patent Number: 4,884,255

[45] Date of Patent: Nov. 28, 1989

[54] DIGITAL CHESS CLOCK

[76] Inventor: Robert J. Fischer, Box 50271, Pasadena, Calif. 91105

[21] Appl. No.: 228,610

[22] Filed: Aug. 5, 1988

[51] Int. Cl.[4] ..... G04F 3/00

[52] U.S. Cl. ..... 368/96

[58] Field of Search ..... 368/3, 89, 96, 107–113

[56] References Cited

U.S. PATENT DOCUMENTS

| | | | |
|---|---|---|---|
| 4,062,180 | 12/1977 | Meshi et al. | 58/145 |
| 4,079,583 | 3/1978 | Larsen | 368/96 |
| 4,472,067 | 9/1984 | Richardson et al. | 368/96 |

OTHER PUBLICATIONS

*Chess Life,* Jun. 1985, p. 39, Advertisement for "Kaisha 1000".

*Official Rules of Chess,* 2nd. ed., 1977, David McKay Company, Inc., 1977, effective 1/1/78.

*Primary Examiner*—Vit W. Miska

*Attorney, Agent, or Firm*—J. T. Martin; Kevin J. Dunleavy

[57] ABSTRACT

A game timing apparatus and method for simultaneously timing events for two players is disclosed. The method involves presetting a pair of clocks for respective initial time periods, starting one of the clocks to time a first player's move, simultaneously stopping one clock and starting the other, and incrementing or decrementing each of the clocks by a time interval once for each move or a group of moves. The apparatus includes a pair of clock means, a pair of start switches for starting and stopping the clock means, and a compensation means for incrementing or decrementing each clock means by a time interval.

20 Claims, 2 Drawing Sheets

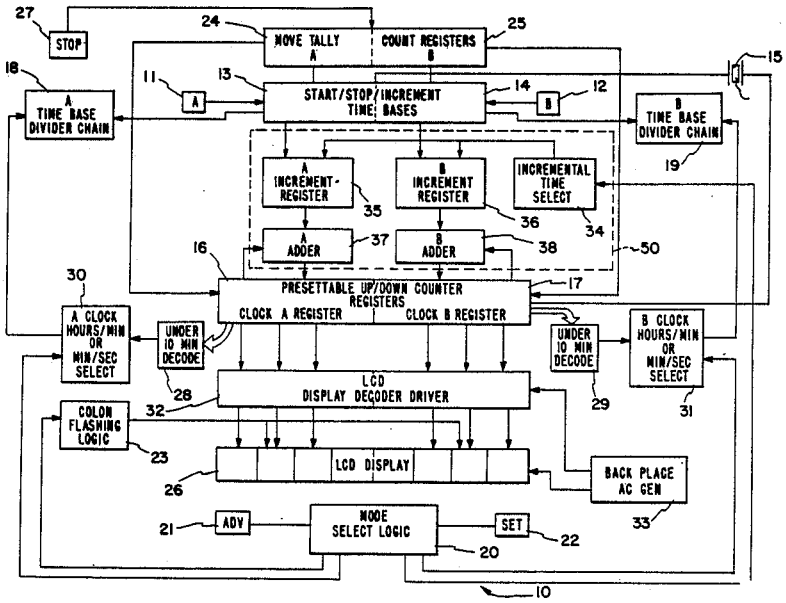

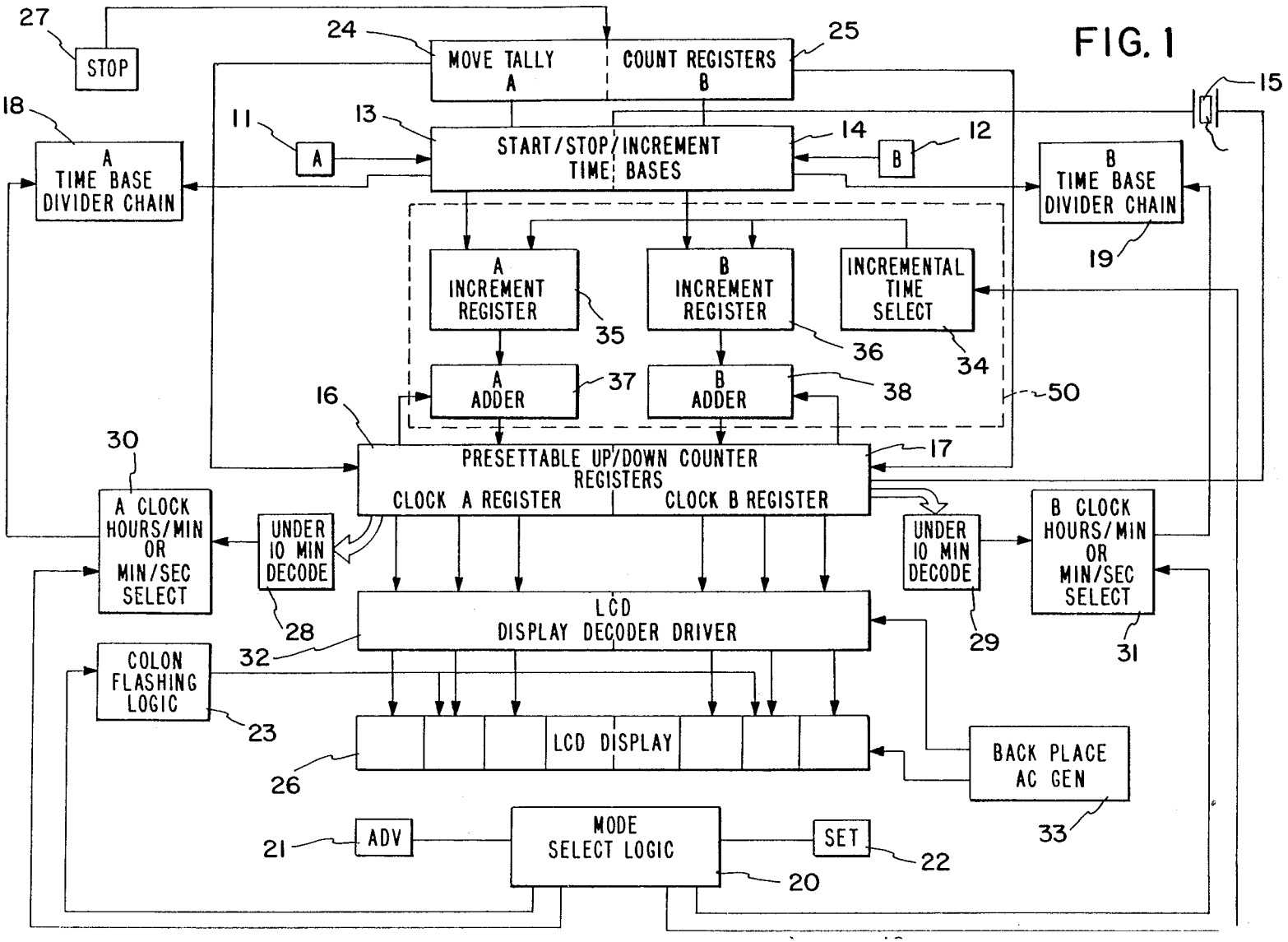
FIG. 1
15
B TIME BASE DIVIDER CHAIN
19
B CLOCK HOURS/MIN OR MIN/SEC SELECT
31
BACK PLACE AC GEN
33
50
12
B
INCREMENTAL TIME SELECT
34
UNDER 10 MIN DECODE
29
17
22
SET
25
14
COUNT REGISTERS B
36
38
B INCREMENT REGISTER
B ADDER
PRESETTABLE UP/DOWN COUNTER REGISTERS
CLOCK B REGISTER
LCD DISPLAY DRIVER
LCD DISPLAY
MODE SELECT LOGIC
20
MOVE TALLY A
START/STOP/INCREMENT TIME BASES
35
37
A INCREMENT REGISTER
A ADDER
CLOCK A REGISTER
24
13
16
UNDER 10 MIN DECODE
28
32
26
ADV
21
A
11
23
COLON FLASHING LOGIC
A CLOCK HOURS/MIN OR MIN/SEC SELECT
30
STOP
27
A TIME BASE DIVIDER CHAIN
18

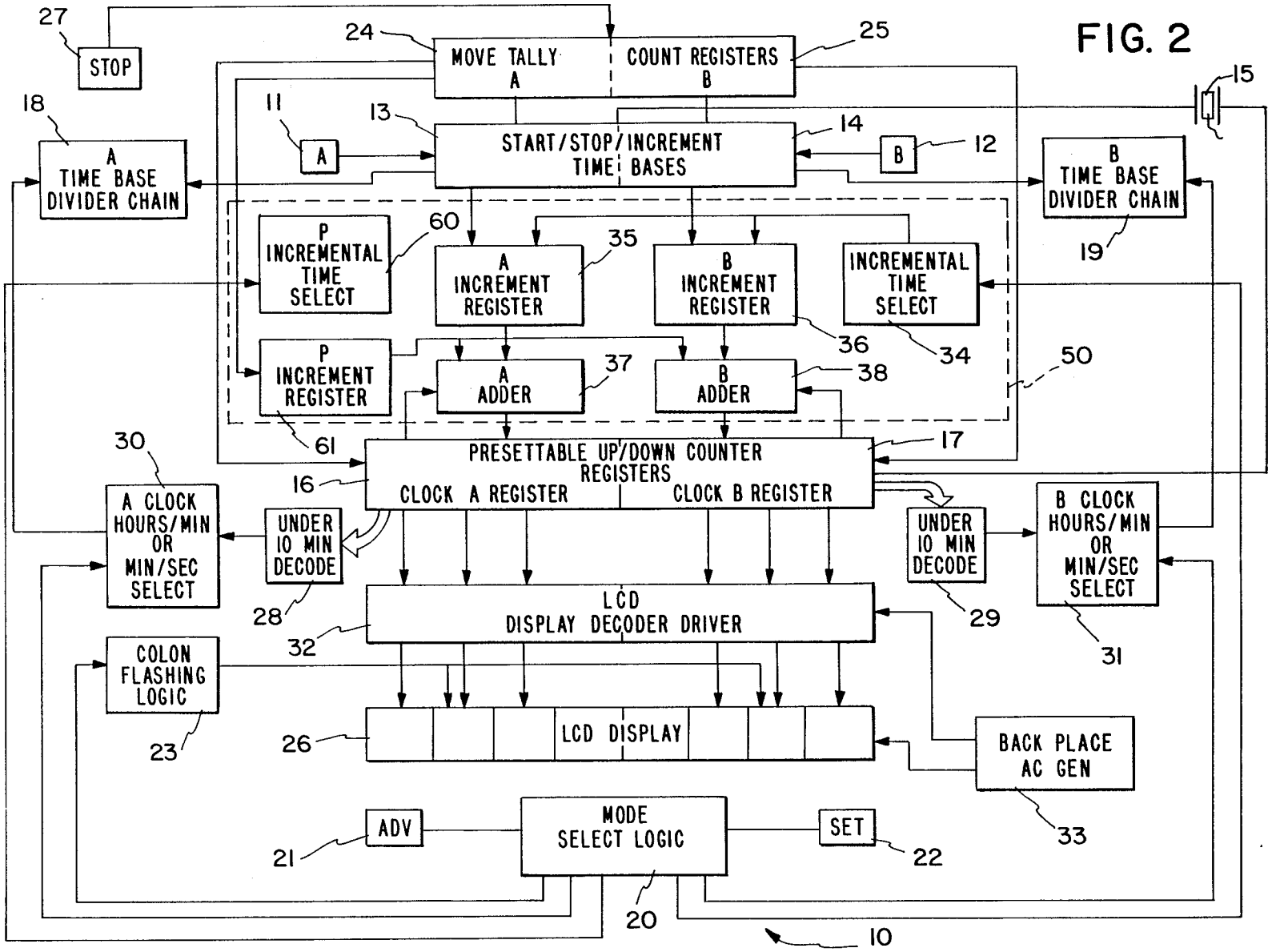
FIG. 2
B TIME BASE DIVIDER CHAIN
B CLOCK HOURS/MIN OR MIN/SEC SELECT
BACK PLACE AC GEN
INCREMENTAL TIME SELECT
UNDER 10 MIN DECODE
COUNT REGISTERS B
START/STOP/INCREMENT TIME BASES
B INCREMENT REGISTER
B ADDER
PRESETTABLE UP/DOWN COUNTER REGISTERS
CLOCK B REGISTER
CLOCK A REGISTER
LCD DISPLAY DECODER DRIVER
LCD DISPLAY
SET
MODE SELECT LOGIC
MOVE TALLY A
A INCREMENT REGISTER
A ADDER
P INCREMENTAL TIME SELECT
P INCREMENT REGISTER
UNDER 10 MIN DECODE
ADV
A CLOCK HOURS/MIN OR MIN/SEC SELECT
COLON FLASHING LOGIC
STOP
A TIME BASE DIVIDER CHAIN
B
A
10
11
12
13
14
15
16
17
18
19
20
21
22
23
24
25
26
27
28
29
30
31
32
33
34
35
36
37
38
50
60
61

DIGITAL CHESS CLOCK

FIELD OF THE INVENTION

The invention relates to a clock for timing two different events. More particularly, the present invention relates to a clock for use in timing tournament game competitions such as chess, shogi, checkers, etc.

BACKGROUND OF THE INVENTION

Competitive chess is played worldwide by thousands, perhaps even millions, of people. As a matter of practicality, chess clocks are used for tournament games. The rules promulgated by various chess organizations set out the amount of time to be allotted for a chess game.

A typical chess clock includes two clocks and two switches. Each switch starts one clock and stops the other clock simultaneously. Thus, as a player completes a move, he pushes his switch which stops his clock and starts his opponent's clock. In this manner, each player's time taken for the game is measured.

In most timed chess matches or tournaments, the time for each player is divided into periods, a primary period and one or more additional secondary periods. These time periods are set out in the official rules of chess promulgated by either national or international organizations. Typically, the primary period is 2 hours long and each player is expected to have completed at least 40 moves in this 2-hour period If one player does not complete his 40 moves within the 2-hour primary period, he will forfeit the game.

The primary period is typically followed by secondary periods of one hour duration wherein each player is expected to complete an additional 20 moves. As many secondary one-hour periods are employed as are necessary to complete the game. Any time remaining to a player by virtue of being left over from the primary period is credited as extra time in the secondary period. In addition, any time remaining after the first secondary period is carried over to the second secondary period and so on. Time only runs against the player while it is his turn to move and runs from the moment it is his turn to move until he makes his move. This particular scheme of timing chess matches is currently the standard for competitive chess events worldwide.

Many different time periods are used in competitive chess besides the 2-hour primary period. In the United States for example, rated chess games can employ anywhere from 30 to 150 minutes for the primary period.

Due to the lengths of the primary and secondary chess games can last for many hours. For example, when employing a 2-hour primary period, a chess game can take up to 4 hours to complete the first 40 moves. Many competitive chess games are adjourned after 4, 5 or 6 hours of play. Upon adjournment, one player writes down his next move and seals it in a sealed envelope. The game position is then recorded and the game is suspended until a convenient time to resume the game. In international chess, for example, most games are adjourned overnight and resumed the following day. During the adjournment period, the players invariably analyze the game position until the game is resumed. Further, the players analyze the position with other players, friends and kibitzers. Chessbooks that specialize in endgame positions, and increasingly, chess computers, are also used as further aids.

The result of adjournments is often a skewing of a particular player's chess-playing ability since the success or failure of a player upon resumption of an adjourned game often depends on the amount of time spent analyzing the game during the adjournment as well as the quantity and quality of help that player had in analyzing the game during the adjournment. In matches between top-class Soviet chess players, each player typically employs a team of several grandmasters whose job it is to spend all night during an adjournment analyzing the position in order to find the best series of moves for that player. Chess endgame books and chess computers are employed as further aids in plumbing the depths of the adjourned position. Thus, the play of the game upon resumption of the adjournment does not necessarily reflect the ability of a particular player, but rather it may be more a reflection of the ability of his team of analysts, books and computers. There are many people, including the present inventor, who wish to eliminate adjournments for exactly this reason. A chess game should be an accurate reflection of the ability of a particular player and not a reflection of the strength and ability of his team of analysts, books and computers.

Another problem with the present timing system for competitive chess is that the number of moves which must be made during the primary time period is arbitrarily selected. While at first glance this may not seem important, the arbitrary selection of the number of moves has a major impact on competitive chess games. For instance, selecting 40 moves to be completed in the primary period of 2 hours means that each player has 2 hours to complete his 40 moves and also that each player can allot his 2 hours among his 40 moves any way that player chooses to. The result of such a system is that perhaps too many games are decided between moves 30 and 40 because many players will take an inordinate amount of time for their first 30 moves and be left with but a few minutes to complete their remaining 10 moves. The result is often a mad time scramble to complete move 40 before the 2-hour period runs out. Numerous games are decided by blunders (sometimes gross blunders) during such time scrambles.

Again, the decision of a chess game on the basis of several moves made during a time scramble may not accurately reflect the chess-playing ability of the players. Rather, it often reflects the ability of each player to budget his time appropriately. There are many people, including the present inventor, who feel that one's ability to budget time should not be such a decisive factor in deciding who wins and loses competitive chess games.

Two electronic chess clocks for timing competitive chess games are known. Both of these clocks employ the sanctioned timing system described above.

The first of these two clocks is described in U.S. Pat. No. 4,062,180 (Meshi et al) issued on Dec. 13, 1977. This clock includes a digital display for each player, a digital memory means for storing and counting down each player's time period, switch means for activating the countdown, and add time means for adding unused time from the primary time period to the secondary time period. This clock is unwieldly and since it employs the sanctioned timing method, suffers from all of the disadvantages discussed herein.

The second of the electronic chess clocks is disclosed in U.S. Pat. No. 4,472,067 (Richardson et al) issued on Sept. 18, 1984. This clock includes a pair of start switches, a pair of clock means, an LCD display means, reset and advance switches for setting the clock means, and counter means for counting the number of operations of the start switches. Again, this electronic clock employs the sanctioned timing method and suffers from all of the disadvantages discussed herein. A clock similar to that disclosed by the Richardson et al patent is available from Kaisha Electronics, P.O. Box 40069, Pasadena, CA 91104 under the trademark "Kaisha 1000."

Accordingly, there is a need in the art for a new set of chess rules, a new method of timing chess games and an apparatus capable of performing the new timing method which will eliminate adjournments from competitive chess and which will eliminate the need for selecting an arbitrary number of moves to be completed in a primary time period.

SUMMARY OF THE INVENTION

The present invention relates to a timing device for timing two events. The timing device includes a clock means for timing two different events. Further, the timing device includes compensation means coupled to the clock means for incrementing or decrementing each of the clock means. The timing device includes a pair of start switches coupled to the clock means, each of which starts one of the clock means for timing one event and simultaneously stops the other of the clock means to interrupt the timing of the other of the two different events. At least one of the start switches is also coupled to the compensation means for actuation of the compensation means. The timing device includes a display means coupled to the clock means for displaying the time for each of the two different events. Finally, the preferred timing device includes various alarm means, including a synthesized voice means.

In accordance with a second aspect thereof, the present invention relates to a method for timing a two-player game. The method comprises presetting each of a pair of clock means for respective time periods. Then, one of the clock means is started to time the first player's move. The next step involves simultaneously stopping the one clock means and starting the other clock means to time the second player's move. The final step involves incrementing or decrementing each of the clock means once for each move.

It is the primary object of the present invention to provide a timing device for timing two events which employs a compensation means to increment or decrement each of the two clocks of the timing device in order to provide the ability to time two players for an unlimited number of moves.

It is a still further object of the present invention to provide a timing device for use in timing competitive chess which, by encouraging quality chess in a reasonable time frame, allows the game to be concluded in one sitting.

It is a further object of the present invention to provide a timing device for use in timing competitive chess games which eliminates the time scramble often associated with the completion of the primary (and sometimes secondary, etc.) time periods.

It is a further object of the present invention that as a player approaches the end of his alloted time for his move and must soon make a move or else forfeit the game, that he is warned by various audible alarms, including a synthesized voice count-down timer. This allows the player in time pressure the benefit of concentrating fully on the game rather than being forced to continuously turn his head to look at the clock to see how much time he has left, and virtually eliminates the possibility of inadvertently losing by forfeit because he oversteps tee time limit.

It is yet another object of the present invention to allow a method and apparatus for timing competitive chess games which obviate the need for arbitrary selection of a number of moves to be completed in the primary and subsequent time periods.

These and other objects of the present invention will be apparent to one of ordinary skill in the art from the detailed description which follows.

BRIEF DESCRIPTION OF THE DRAWINGS

FIG. 1 is a functional block diagram of one embodiment of the timing device of the present invention.

FIG. 2 is a functional block diagram of the preferred embodiment of the timing device of the present invention.

DETAILED DESCRIPTION OF THE PREFERRED EMBODIMENTS

The preferred embodiment of the present invention is described with reference to the timing of competitive chess games, and speed chess games. However, it is to be understood that the timing method and apparatus of the present invention can be used in a wide variety of applications.

The present invention proposes an entirely new method for timing competitive chess matches. This method is not presently recognized by either national or international rules.

One mode of the timing method of the present invention is conceptually different than that presently employed in competitive chess. Instead of employing prescribed time periods during which each player is required to make a prescribed number of moves, the present method is based on allotting a time interval for each move. In the sanctioned timing method presently used in competitive chess a primary period of 2 hours requiring each player to complete 40 moves works out to an average of 3 minutes per move.

In one mode of the present invention, each player is allotted an initial time period for the entire chess game. Thus, there are no secondary time periods as in the timing method presently used in competitive chess. Then, each time a player makes a move under the timing system of the present invention, a predetermined interval of time will be added to the time remaining from that player's initial time period. Accordingly, each player will receive an additional interval of time for every move throughout the entire game. As an example of the present method, one may select an initial time period of 62 minutes (60 minutes plus the first two minutes which is credited prior to the first move) for each player. Each player's clock is preset to give a 62-minute time period for the entire game. Then, a time interval such as 2 minutes is selected. Assuming that the first player takes 10 seconds for his first move, he will have 61 minutes and 50 seconds remaining from his initial 62-minute time period. Upon completion of his first move, the preselected 2-minute interval will be added to the first player's time, thus giving him a total of 63 minutes and 50 seconds remaining on his clock. The same procedure is repeated for the second player and then the first player makes his second move. Assuming that the first player's second move takes 45 seconds, his clock will have 63 minutes and 5 seconds remaining. Again, upon completion of his second move, the 2-minute interval will be added to the first player's time to give him 65 minutes and 5 seconds for the remainder of the game. This procedure is continued throughout the entire game until either the game is decided on the board or one player uses up all of his allotted time.

It should be noted that if a 2-minute interval is selected, a player will always have 62 minutes remaining on his clock if that player spends exactly 2 minutes on every single move during the game. For each move that a player spends less than 2 minutes, he will accumulate additional time on his clock for use on future moves. For each move that a player spends more than 2 minutes, a player will use up some of his stored up time from either previous moves or from his initial time period.

In another embodiment of the invention, the compensation means can be used to add several (admittedly arbitrarily selected) time periods in addition to the time intervals, throughout the game. For example, an initial time period of 32 minutes may be selected and an interval of 2 minutes per move may be added until the twentieth move. Upon making their twentieth move, each player can be credited with an additional 30 minute period above and beyond the 2 minute intervals credited after each move (a total of 32 minutes). 30 minutes can be added after each group of 20 moves in this manner. This timing system has the effect of spreading the initial period over the entire game to produce an even greater reduction in the possibility for a time scramble. Both the time periods and number of moves upon which the addition of the time periods is based, can be presettable so that they can be selected by the players.

The timing system of the present invention has several significant effects on the conduct of a typical competitive chess game. The first significant effect is that the timing method of the present invention virtually eliminates severe time pressure or time scramble and provides no convenient point during the chess game at which to adjourn the chess game. In contrast, the timing method presently used in competitive chess provides an opportune time for adjourning a game, namely the end of the primary time period. The elimination of a convenient point for adjournment is a significant effect, since it will serve to discourage the adjournment of competitive chess games and tend to encourage completion of chess games in a single sitting. But, the main reason the chess clock of the present invention should discourage adjournment of games is because the clock, by encouraging better chess in less time, should obviate the need for adjourned games.

The number one advantage of the timing system of the present invention is that it will tend to eliminate time scrambles which are often associated with the end of the primary period of the timing system presently employed in competitive chess. As an example, under the sanctioned system, a player can use 1 hour and 59 minutes of his 2-hour primary period for his first 20 moves. Then, he will be required to complete his next 20 moves in the remaining 1 minute. This results in a time scramble since that player has about 3 seconds for each of his remaining 20 moves.

Time scrambles occur quite regularly in competitive chess games and often prove decisive. As a result, there are a significant number of players who would like to eliminate such time scrambles from competitive chess. The timing system of the present invention serves this purpose since a player cannot put himself in a position where he has only 1 minute to make 20 moves. Under the system of the present invention, a player will always have at least the time interval which is added to his clock after every move to complete his next move. Thus, using the example given earlier wherein the time interval is 2 minutes, a player will always have at least 2 minutes for every move. This will serve to minimize the effect of time scrambles since requiring one move in 2 minutes is much more reasonable than requiring 20 moves in 1 minute. The timing system of the present invention, therefore, has the effect of budgeting a player's time for him by guaranteeing him one additional short interval of time after each move rather than allowing a player to misuse his time and place himself in an almost impossible situation of having to make many moves in a very short (perhaps only seconds) period of time.

Another effect of the timing system of the present invention is (in one mode) to eliminate the arbitrary selection of a number of moves to be completed in a primary time period. Using the timing method of the present invention, no number of moves need be selected since a time interval is added after each move.

The timing method of the present invention has the further advantage that it will smooth out the play of competitive chess games. Under the presently sanctioned system, players can typically spend 1 hour or more on a single move during the primary period and they can spend 30 minutes or more on a single move during each of the secondary periods. This leads to a very uneven game since often many moves will be made in a few minutes and a very few moves will take a very large number of minutes. Under the system of the present invention, the ability to spend a large amount of time on a single move will be somewhat limited since the only way to gain additional time on your clock is to make additional moves. As a result, players will be encouraged to make additional moves in order to gain additional time on their clocks. Further, under the system of the present invention, a player will only gain a short interval of time each additional move that he makes. Whereas, under the presently sanctioned system, a player can gain 1 hour or more by playing enough moves to reach a secondary time period.

Another advantageous feature of the Bobby Fischer Chess Clock is its applicability to speed chess, a form of competitive chess where each player is generally given 5 or 10 minutes to complete an entire game. In a typical prior art speed chess game, one player falls behind on the clock and strives desperately to complete the game before the expiration of his time. Since each player is given a single, non-renewable time period, once a player is behind on the clock, he usually remains behind for the duration of the game and thus, despite a clearly won position on the gameboard, can be beaten merely by temporary avoidance of checkmate by his opponent until his clock runs out.

The situation is entirely different when the Bobby Fischer chess clock is employed to time a speed chess game. Under this timing system, each player is given, for example, three minutes initial time plus two seconds per move. This version of speed chess is vastly improved because each player will have at least two seconds for each move and thus players with a clearly won position will have sufficient time to finish their opponent with checkmate. This being the case, players will be more inclined to play better chess, rather than faster and worse chess which is encouraged by the present speed chess timing system. Moreover, players will no longer have incentive to play out hopelessly lost positions in the hope of winning by time forfeit. Thus, Bobby Fischers's Chess Clock should greatly improve the quality of speed chess.

Referring to the FIG. 1, the chess clock 10 of the present invention is shown in electrical block diagram form. Start switches 11 and 12 are the switches used by player A and B respectively to indicate that a move has been completed. Start switches 11 and 12 stop the time running against the player who has completed his move and start the time running against the other player. These start switches 11 and 12 are pressure sensitive with relatively large surface areas which can be easily found by the player without looking at chess clock 10. Depression of start switch 11 by player A stops a time base 13 and starts a time base 14. Depression of start switch 12 stops time base 14 and starts time base 13. Perhaps preferably, an indication of the depression of either one of the start switches 11 and 12 will be made audible through a sound transducer 15 as a low level audio tone to alert each player that a start switch 10 or 11 has been depressed. Sound transducer 15 is also connected to a pair of presettable up/down counters 16 and 17 to emit an audio tone when either of the up/down counters 16 or 17 reaches zero.

In an alternative embodiment, sound transducer 15 can be replaced by a standard, commercially-available voice synthesizer (not shown). The voice synthesizer can be used to indicate, by words, the actuation of start switches 11 and 12, when up/down counter 16 or 17 reaches zero, and the voice synthesizer may even indicate the approach of up/down counters 16 and 17 to zero by saying "2 minutes" when either of the up/down counters 16 and 17 reaches 2 minutes and by saying "1 minute" when either of the up/down counters 16 and 17 reaches 1 minute. The circuitry necessary for these functions is well known to those of ordinary skill in the art.

Signals from the time bases 13 and 14 will cause the presettable up/down counters 16 and 17 to start a countdown or stop a countdown through a pair of time base divider chains 18 and 19, respectively.

A mode select logic circuit 20, together with an advance switch 21 and a set switch 22, are used to select the initial period for the game and control a colon flashing logic circuit 23 which allows the user to easily understand which figures on the display are being reset. The typical indication that figures are being reset is a flashing of the digits being reset. The mode select logic circuit 20 is also used to provide an indication of whether the game is stopped for some reason and of how many moves have been made by each player.

A tally of the moves made by each player is stored in one or the other of a pair of move-tally count registers 24 and 24 which receive signals from the time bases 13 and 14 which indicate a single switching of start switches 11 and 12, respectively; corresponding to a move. The tally from each of the move-tally count registers 24 and 25 is communicated to the respective up/down counters 16 and 17 for display on an associated LCD display 26 through an LCD display decoder driver circuit 32. LCD display 26 also receives inputs from the mode select logic 20 under the control of advance switch 21. During a match, depressing of a stop switch 27 connected to registers 24 and 25 will case the tallies in each of the registers 24 and 25 to be held and will also stop the countdowns occurring in up/down counters 16 and 17. A subsequent depression of either of the start switches 11 or 12 will resume the countdowns occurring in up/down counter registers 16 and 17 at the points where the counts left off.

In a preferred embodiment, if the time in the up/down counters 16 and 17 is 10 minutes or less, the 10-minute decode circuits 28 and 29 will cause the A clock select circuit 30 and B clock select circuit 31 to au tomatically change the display on the LCD display 26 from an hours and minutes display to a minutes and seconds display. The A clock select and B clock select circuits 30 and 31 control the time base divider chains 18 and 19 respectively which cause the display in the LCD display 26 to show either hours and minutes or minutes and seconds.

The LCD display 26 is driven from up/down counters 16 and 17 by LCD display decoder driver 32 and backplane A.C. generator 33. Typically, in the preferred embodiment, not all digits of the LCD display 26 are used since games are rarely set to run for more than 9 hours and 59 minutes.

Also shown in the figure is a compensation circuit 50 (defined by the dotted line) connected between the A and B time bases 13 and 14 and the A and B up/down counters 16 and 17 and which includes an incremental time select circuit 34 operated by set switch 22 through the mode select logic circuit 20. Incremental time select circuit 34 allows the players to select the interval of time by which the compensation circuit 50 will increment or decrement the up/down counters 16 and 17. The selected time interval is stored in an A increment register 35 and a B increment register 36 upon completion of the setting of the time interval using the incremental time select circuit 34. The A increment register 35 and B increment register 36 are also connected to time bases 13 and 14, respectively, and to an A adder 37 and a B adder 38, respectively, which are, in turn, connected to up/down counters 16 and 17 respectively.

In operation, actuation of start switch 11 signals time base 13 which causes the A increment register 35 to send a signal representative of the value of the selected time interval to the A adder 37 where the time interval is added to the amount of time recorded in up/down counter 16. A signal representative of the sum of the time from up/down counter 16 and the time interval from A increment register 35 is then sent to up/down counter 16 by A adder 37 to replace the existing value. In this manner, each player's clock is incremented as a result of actuation of start switches 11 and 12, respectively.

The majority of the circuitry for the chess clock of the present invention is described in detail in U.S. Pat. No. 4,472,067 issued on Sept. 18, 1984, which is hereby incorporated by reference, and suitable conventional circuitry can be used to implement the incremental time select circuit 34, the A increment register 35, the B increment register 36, the A adder 37 and the B adder 38. In addition, the "Kaisha 1000" chess clock referred to herein is currently commercially available and contains all the circuitry required for the clock of the present invention except the compensation circuit 50.

Referring to FIG. 2, there is shown a block diagram of the preferred embodiment of the chess clock lo of the present invention. This embodiment is the same as that shown in FIG. 1 except that it includes a P incremental time select 60 and a P increment register 61. The P increment register 61 is connected to A adder 37 and B adder 38 as well as move count tally registers 24, 25 and P incremental time select 60. P incremental time select 60 is connected to P increment register 61 and to mode select logic 20.

In operation, P incremental time select 60 and P increment register 61 are employed in combination to spread the initial time period over the entire game rather than just providing a single initial time period as in the embodiment shown in FIG. 1. More particularly, the P incremental time select 60 and P increment register 61 provide the chess clock 10 with the ability to credit each player with an additional time period upon completion of a specified number of moves. This additional time period is above and beyond the initial time period discussed earlier, and is also above and beyond the time intervals which are added after each move by the A increment register 35 and B increment register 36. Thus, for example, the P incremental time select 60 and P increment register 61 may be used to add an additional time period of 20 minutes to each player's clock upon completion of each group of 20 moves. In this manner, the initial time period can be reduced to 22 minutes, (instead of 62 minutes), for example, and the remaining time periods can be spread out such that it is credited 20 minutes after 20 moves and 20 additional minutes after 40 moves, 20 minutes after 60 moves, etc. This embodiment has the effect of further evening out the timing of the game to provide an even greater reduction in the possibility for a time scramble.

In operation, the P incremental time select 60 is accessed through the mode select logic 20 during the setting stage of using the clock. The P incremental time select 60 provides the ability to set both the amount of time to be added as well as the number of moves after which that time period is added. For example, it can be set to add 20 minutes after each group of 20 moves are completed by the players. Once it is set, this information is fed to the P increment register 61 where it is stored until needed. The P increment register 61 is connected to the move count tally registers 24, 25 to keep track of the number of moves which have been completed. Upon completion of the preset number of moves, the P increment register 61 sends the additional time period to both A adder 37 and B adder 38 to be added to each players presettable up/down counter registers 16, 17. Suitable conventional circuitry can be used to implement the P incremental time select 60 and the P increment register 61.

The preferred embodiment of the chess clock 10 may be operated in a simple and efficient manner. Since the preferred embodiment has no power switch, the first step is to press the stop switch 27 for at least 1.25 seconds to cause the display of the digits on the LCD display 26. Then the players will set the game period in the following manner:

1. Press the set switch 22. The minutes digits of the B player's LCD display 26 will begin flashing. Press the advance switch 21 until the minute digits of the B player's display on the LCD display 26 are correct for the chosen initial time period. It should be noted that holding the advance switch 21 down for more than 1 second will cause the flashing numbers to advance more rapidly.

2. Press the set switch 22 again. This will cause the hours digit of the B player's display of LCD display 26 to flash. Press the advance switch 21 until the hours digit is correct for the chosen initial time period.

3. Press the set switch 22 again. This will cause the minutes digits of the A player's display to flash. Press the advance switch 21 until the minutes displayed correspond to the correct amount of minutes for the chosen initial time period.

4. Press the set switch 22 again. This will cause the hours digit of the A player's display to flash. Press the advance switch 21 until the hours digit corresponds to the correct number of hours of the chosen initial time period.

5. Press the set switch 22 again. This will cause the minutes digit of the B player's display of LCD display 26 to begin flashing. Press the advance switch 21 until the displayed number of minutes corresponds to the correct time interval by which the B player's clock will be incremented after each move.

6. Press the set switch 22 again. This will cause the minutes digit of the A player's display to begin flashing. Press the advance switch 21 until the minutes digit of the LCD display 26 corresponds to the correct number of minutes for the interval by which the A player's clock will be incremented after each move.

7. Press the set switch 22 again. This will cause the minutes digits of the A player's display to being flashing. Press the advance switch 21 until the minutes digit of the LCD display 26 corresponds to the correct number of minutes for the additional period by which each player's clock will be incremented after a given number of moves.

8. Press the set switch 22 again. This will cause the minutes digits of the B player's display to begin flashing. Press the advance switch 21 until the minutes digit of the LCD display 26 correspond to the correct number of moves after which the additional time period will be added to each player's clock.

9. Press the set switch 22 again. This will cause all displays to stop flashing. Then press the stop switch 27 to ready the chess clock 10 for counting down.

If any mistake is made. press the stop switch 27 and follow the foregoing procedure again. Once the time for both players A and B and the time intervals for players A and B have been set, the chess clock 10 is ready to start counting down after pressing the stop switch 27. Whomever is the player having the first move should request his opponent to press his start switch 11 or 12 to begin the counting down of the player with the first move's time period. Pressing the stop switch 27 thereafter will freeze both counts in case a rest period is desired or if there is a dispute over the rules which requires the stopping of both clocks for consultation with the tournament director, or a power failure so the lights go out, etc. When the time out or rest period is over, the player who was to move next has his opponent press his start switch 11 or 12 to start the countdown for the player with the next move.

To display the number of moves which each player has made, simply press the advance switch 21 without first pressing the set switch 22 and the number of moves will be displayed for the period that the advance switch 21 is depressed.

To turn off the display, simply depress the stop switch 27 for at least 1.25 seconds and the display will disappear. The timing of both clocks, move count and both time intervals remain stored in memory and can be recalled to view by pressing stop switch 27 for longer than 1.25 seconds to thereby cause the display to return. If, however, player switches 11 and/or 12 have been activated at least once as in the progress of a game, then pressing the stop switch 27 will simply put the timing of both players on hold. If the players decide not to resume play at once, they may store the respective times, move counts and time intervals in memory by pressing the set switch 22 and then pressing the stop switch 27 for longer than 2 seconds. This will store the respective times, time intervals and move counts in memory so that accidental pressure upon start switches 11 or 12 will not alter the times indicated prior to resumption of play. When play is to resume, the stored time periods, time intervals and move counts can be recalled simply by depressing the stop switch 27 for a period in excess of 1.25 seconds.

There are several possible methods for the compensation circuit 50 to increment the clock means within the scope of the present invention. The simplest method is to connect compensation circuit 50 to either start switch 11 or start switch 12 such that compensation circuit 50 increments both clocks upon actuation of one of start switches 11 or 12. Another method is to connect compensation circuit 50 to both start switches 11 and 12 such that actuation of each start switch 11 or 12 will increment one of the clocks. This also provides two possibilities: namely actuation of start switch 11 incrementing up/down counter 16 and actuation of start switch 12 incrementing up/down counter 17, or actuation of start switch 11 incrementing up/down counter 17 and actuation of start switch 12 incrementing up/-down counter 16.

It is important to note that compensation circuit 50 should be connected such that it will increment each clock once for each move made by each player. Thus, in the situation where compensation circuit 50 is connected to a single start switch to increment both clocks, it should be connected to the second player's start switch such that both clocks will be incremented after both players have completed a move. In the case where compensation circuit 50 is connected to both start switches 11 and 12, then it is important to ensure that compensation circuit 50 does not increment any chess clock upon the first press of either start switch 11 or 12 used to start a game or upon the first press of any start switch used to restart a game. This can be done simply by sending a signal from stop switch 27 to compensation circuit 50 such that compensation circuit 50 will not increment for the first actuation of a start switch 11 or 12 after actuation of stop switch 27.

The foregoing description of embodiments of the invention has been presented for purposes of illustration and description. It is not intended to be exhaustive or to limit the invention to the precise forms disclosed, and many modifications and variation will be obvious to one of ordinary skill in the art in light of the above teachings. Accordingly, the scope of the invention is to be determined by the claims appended hereto.

What is claimed is:

1. A timing device for timing two events which comprises:

a pair of clock means for timing two different events; compensation means coupled to said clock means for incrementing or decrementing each of said clock means;

a pair of start switches coupled to said clock means, each of which starts one of said clock means for timing one event and simultaneously stops the other of said clock means to interrupt the timing of the other of the two different events;

at least one of said start switches also being coupled to said compensation means for actuation of said compensation means; and display means coupled to said clock means for displaying the time for each of the two different events.

2. A timing device as claimed in claim 1 wherein said compensation means is coupled to, and actuated by, one of said start switches and said compensation means, upon actuation, increments or decrements both of said clock means.

3. A timing device as claimed in claim 1 wherein said compensation means is coupled to both of said start switches whereby one of said start switches causes said compensation means to increment or decrement one of said clock means and the other of said start switches causes said compensation means to increment or decrement the other of said clock means.

4. A timing device as claimed in claim 3 wherein said compensation means increments or decrements said clock means which is being started by one of said start switches.

5. A timing device as claimed in claim 3 wherein said compensation means increments or decrements said clock means which is being stopped by one of said start switches.

6. A timing device as claimed in claim 5 further comprising a means for preventing actuation of said compensation means for the first actuation of one of said start switches at the start or restart of the timing of the two different events.

7. A timing device as claimed in claim 1 wherein said compensation means further comprises a means for selecting the amount of time by which said clock means is incremented or decremented.

8. A timing device as claimed in claim 7 further comprising alarm means coupled to said clock means for indicating the completion of the time period for each of the two different events.

9. A timing device as claimed in claim 8 wherein said clock means includes means for presetting said clock means for a certain initial time period for an event, said clock means counts down to zero, and said compensation means increments said clock means.

10. A timing device as claimed in claim 9 wherein said alarm means comprises a voice synthesizer for simulating the human voice.

11. A timing device as claimed in claim 10 wherein said alarm means further indicates the approach of the end of the time period for each of the two different events.

12. A timing device as claimed in claim 11 further comprising a pair of counting means coupled to said start switches for counting the number of operations of each of said start switches and wherein said compensation means is further coupled to said counting means whereby said compensation means increments said clock means upon completion of a number of operations of each of said start switches.

13. A timing device as claimed in claim 12 wherein said compensation means further comprises a means for selecting the number of operations of each of said start switches to be completed before incrementing said clock means.

14. A chess clock for timing a competitive chess game comprising:

a pair of clock means for timing each of the players of the chess game;

a means coupled to said clock means for setting an initial time period for each of said clock means;

a compensation means coupled to said clock means for incrementing each of said clock means;

a means coupled to said compensation means for selecting the amount by which said clock means will be incremented by said compensation means;

a pair of start switches coupled to said clock means, each of which starts one of said clock means for timing one of the players and simultaneously stops the other of said clock means to interrupt the timing of the other of the players; at least one of said start switches also being coupled to said compensation means for actuating said compensation means;

alarm means coupled to said clock means for indicating the expiration of the time period for each of said clock means; and display means coupled to said clock means for displaying the time for each of the players.

15. A chess clock as claimed in claim 14 wherein each of said start switches are coupled to said compensation means and said compensation means increments only said clock means that is being started by said start switch each time said compensation means is actuated.

16. A chess clock as claimed in claim 15 wherein said means for selecting comprises means for independently selecting the amount by which each of said clock means is incremented by said compensation means.

17. A chess clock as claimed in claim 16 wherein said alarm means comprises a sound means and said alarm means further comprises a means for indicating the approach of the expiration of the time period of each of the players.

18. A chess clock as claimed in claim 14 further comprising a counting means coupled to said start switches for counting the number of operations of each of said start switches, and wherein said compensation means is coupled to said counting means for incrementing each of said clock means upon completion of a number of operations of said start switches.

19. A chess clock as claimed in claim 18 wherein said compensation means further comprises a means for selecting the number of operations of said start switches to be completed prior to said compensation means incrementing said clock means.

20. A method of timing a two-player game comprising:

presetting each of a pair of clock means for respective initial time periods;

starting one of said clock means to time the first player's move;

simultaneously stopping one of said clock means and starting the other of said clock means to time the second player's move; and incrementing or decrementing each of said clock means by a time interval once for each move or group of moves.

* * * * *